US011434672B2

(12) United States Patent
Bertani

(10) Patent No.: US 11,434,672 B2
(45) Date of Patent: Sep. 6, 2022

(54) DOOR LOCKING DEVICE

(71) Applicant: ELESA S.p.A., Milan (IT)

(72) Inventor: Alberto Bertani, Milan (IT)

(73) Assignee: ELESA S.p.A., Milan (IT)

( * ) Notice: Subject to any disclaimer, the term of this patent is extended or adjusted under 35 U.S.C. 154(b) by 313 days.

(21) Appl. No.: 16/804,730

(22) Filed: Feb. 28, 2020

(65) Prior Publication Data

US 2020/0284072 A1 Sep. 10, 2020

(30) Foreign Application Priority Data

Mar. 4, 2019 (IT) ..... 102019000003089

(51) Int. Cl.

| | |
|---|---|
| ***E05C 1/08*** | (2006.01) |
| ***E05C 1/00*** | (2006.01) |
| ***E05C 1/16*** | (2006.01) |
| *E05B 15/00* | (2006.01) |
| *E05B 35/00* | (2006.01) |

(52) U.S. Cl.

CPC ..... *E05C 1/002* (2013.01); *E05C 1/166* (2013.01); *E05B 35/008* (2013.01); *E05C 1/00* (2013.01); *E05Y 2900/132* (2013.01); *Y10T 292/0977* (2015.04)

(58) Field of Classification Search

CPC ..... Y10T 292/096; Y10T 292/0969; Y10T 292/0977; Y10T 292/1016; Y10T 292/097; E05C 1/00; E05B 35/008

See application file for complete search history.

(56) References Cited

U.S. PATENT DOCUMENTS 381,131 A * 4/1888 Hartman ..... E05B 63/0017 292/140
748,202 A * 12/1903 Mills ..... E02F 3/4075 292/DIG. 52
758,333 A * 4/1904 Pfleghar ..... E05B 63/0017 292/147
1,979,805 A * 11/1934 Main ..... E05B 63/0017 70/401

(Continued)

FOREIGN PATENT DOCUMENTS

CN 109339578 A 2/2019
DE 202011005498 U1 * 2/2013 ..... E05B 63/0056

(Continued)

OTHER PUBLICATIONS

Search Report for Italian Patent Application No. 102019000003089 dated Oct. 18, 2019.

*Primary Examiner* — Carlos Lugo
(74) *Attorney, Agent, or Firm* — Pearne & Gordon LLP

(57) ABSTRACT

Locking device for the opening of a door including two opposite members apt to be mounted to a door and to a post, respectively, and provided with housing holes of screws for the engagement with a surface, one of the bodies including a solid body except for a cavity provided on one of the side walls, the other one of the bodies including an outside shell internally provided with a housing cavity of a sliding body, characterised in that a lock block for the movement of the sliding body is furthermore provided, housed within a cavity provided on the top surface of the outer shell as well as dampening and thrust structure of the sliding body.

6 Claims, 4 Drawing Sheets

(56) References Cited

U.S. PATENT DOCUMENTS

| | | | | | |
|---|---|---|---|---|---|
| 2,904,855 | A * | 9/1959 | Hagerty | E06B 3/44 | 49/458 |
| 3,006,179 | A * | 10/1961 | Erickson | E05B 63/0017 | 70/379 R |
| 3,762,750 | A * | 10/1973 | Orr | E05B 63/0017 | 292/169.15 |
| 3,782,139 | A * | 1/1974 | Rubner | E05C 1/16 | 70/369 |
| 4,195,867 | A * | 4/1980 | Baillie | E05C 1/10 | 70/81 |
| 4,226,451 | A * | 10/1980 | Gingras | E05B 13/005 | 292/169.21 |
| 6,174,005 | B1 * | 1/2001 | Norton | E05C 1/16 | 292/169.21 |
| 6,343,816 | B1 * | 2/2002 | King | E05B 63/22 | 292/DIG. 37 |
| 7,357,009 | B2 * | 4/2008 | Maloney | E05C 1/16 | 220/210 |
| 8,468,661 | B2 * | 6/2013 | Brownlow | E05B 65/0057 | 27/DIG. 1 |
| 8,777,279 | B2 * | 7/2014 | Kothy | E05B 17/2084 | 292/137 |
| 2013/0067969 | A1 | 3/2013 | Webb et al. | | |
| 2013/0126532 | A1 | 5/2013 | Kothy | | |

FOREIGN PATENT DOCUMENTS

| | | | | |
|---|---|---|---|---|
| FR | 2833987 | A1 | 6/2003 | |
| FR | 2897632 | A1 | 8/2007 | |
| GB | 402276 | A | 11/1933 | |
| SE | 430708 | B | 12/1983 | |
| WO | WO-2012020639 | A1 * | 2/2012 | E05B 35/008 |
| WO | 2017203148 | A1 | 11/2017 | |

* cited by examiner

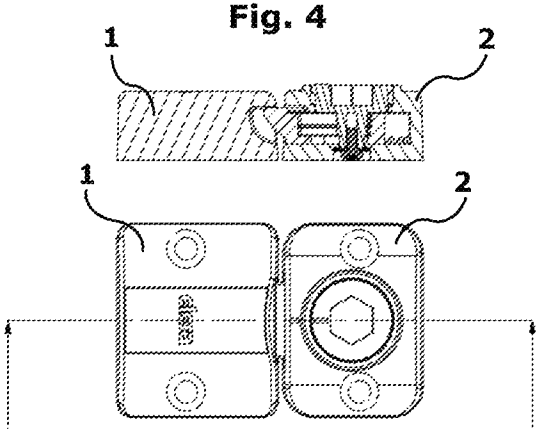
Fig. 4
Fig. 3
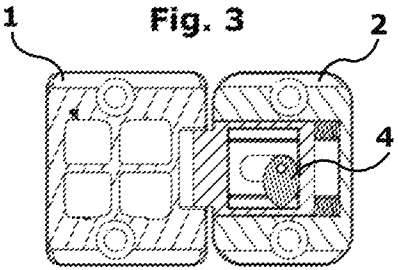
Fig. 5
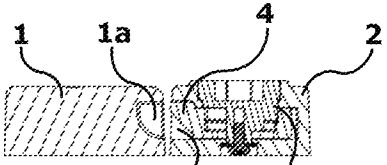
Fig 2
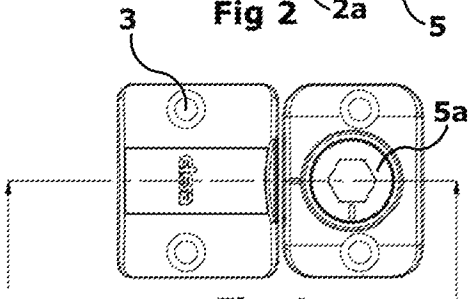
Fig. 1
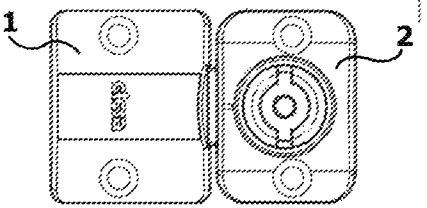
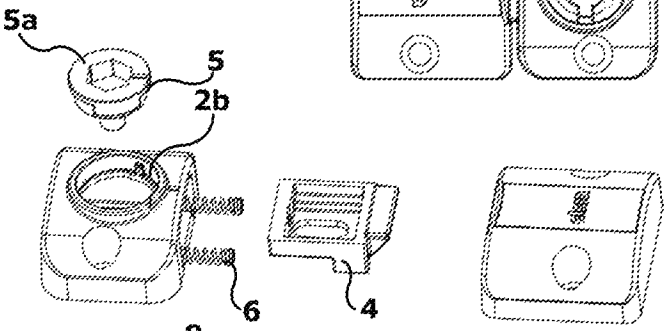
Fig. 6

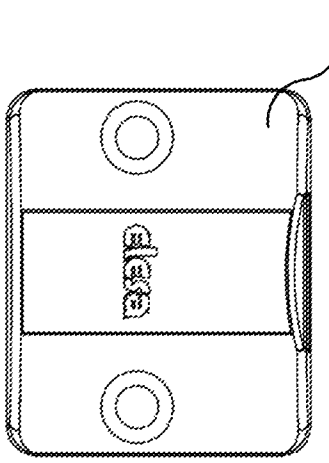
Fig. 8a
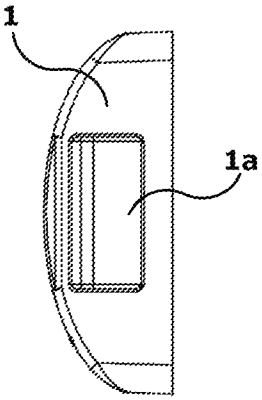
Fig. 8b
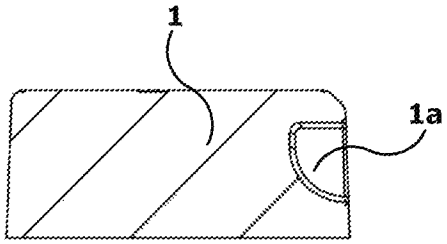
Fig. 8c
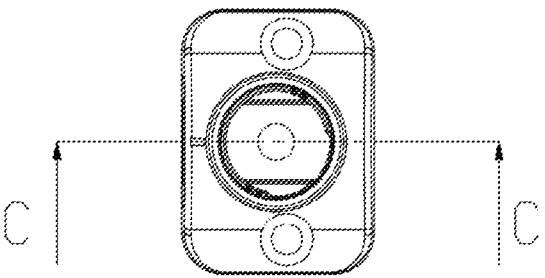
Fig. 9a
Fig. 9b
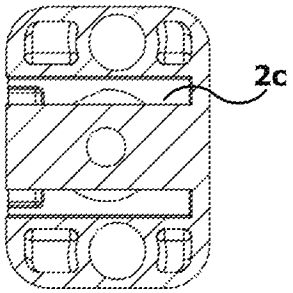
fig. 9c
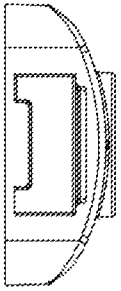
Fig. 9d

DOOR LOCKING DEVICE

FIELD OF THE INVENTION

The present invention relates to a device for locking a door, or cabinet door, with respect to the frame, for example of machinery.

BACKGROUND OF THE INVENTION

The use of such locking devices, typically consisting of two distinct members disposed opposite each other, has been known for some time, both members consisting of a body kept in a stable position by means of screws housed within suitable holes for the engagement with a door and a post, respectively, one of said bodies having a slide free to slide along a directrix, the other one providing a housing groove of said slide.

In the devices available on the market, slide moving means are provided, apt to allow the easy sliding thereof for the engagement or the disengagement of the same with the housing groove provided on the opposite body.

Different types of slide exist: for example, it can have a rectilinear shape, or have a wedge-shaped engagement end, this second solution being particularly preferred in case the slide is provided with engagement springs.

However, the instruments available today have some disadvantages in terms of security, due to the fact that it appears particularly complex to be able to guarantee the correct opening of the door and thus prevent distracted or unauthorised people from accessing an off-limits area.

BRIEF SUMMARY OF THE INVENTION

It is therefore the object of the present invention to accomplish an adjustment device of the opening of a door which allows to obtain the correct and stable closing and opening condition of the door with respect to the frame body.

In the same way, the need has also been acknowledged, and it is therefore a further object of the present invention, to accomplish a door closing device which is not easily opened by ill-intentioned or naive people, but which can be opened by expert and skilled individuals, so as to reduce unpleasant events, in particular a closing device which has lock blocks operating outside of the mounting profiles.

As a matter of fact, in the known door locking devices the abutment of the lock block occurs on the frame at a correct distance with respect to the closing lever. Therefore, the door locking devices present in the market are actually provided with lock blocks having different dimensions of the abutment member and at the same time the availability by the user to accomplish the changes to the frame to define the correct engagement area.

The object of the present invention is therefore to accomplish a door mounting device provided with a lock block which does not provide changes to the frame structure and is universal for any type of door and frame.

Said objects are obtained through an adjustment device of the door opening of the type consisting of two opposite bodies and provided with housing grooves for screws apt to be engaged with a surface, one of said bodies providing a housing cavity of a body equipped with a wedge at the front end thereof kept in engagement by spring means and the other one of said bodies consisting of a box body provided with a housing cavity of said wedge characterised in that said body equipped with a wedge has further actuation means of said spring means.

Other favorite features will be the object of the dependent claims.

BRIEF DESCRIPTION OF THE DRAWINGS

The invention is now described with reference to the drawings, so that the innovative scope thereof as well as the structural features thereof can be best understood.

FIG. 1 is a top plan view of the device according to the invention, in an open-door position, of which FIG. 2 is the side section view;

FIG. 3 is the top plan view of the device according to the invention, in a closed-door position, of which FIG. 4 is the lateral section view FIG. 5 is a bottom plan, part-section view of the device according to the invention in the condition of FIG. 3, FIG. 6 is an exploded view of the device of FIGS. 1 to 5;

FIGS. 8*a*-8*c* are top-plan, front and side-section views of the body provided with the housing cavity of FIG. 1

FIGS. 9*a*-9*d* are top-plan views, in section along the line C-C, front, rear, side and bottom-plan, cross-section views of the member provided with the slide;

DESCRIPTION OF EXAMPLE EMBODIMENTS

Figure 7C:
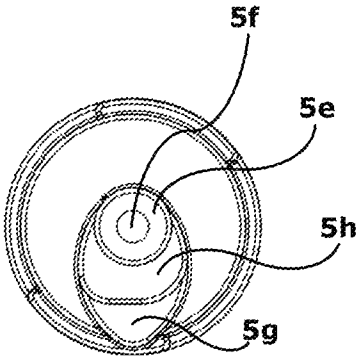
FIGS. 7*a*-7*d* are top plan, side-front views, from below and side-section views of the body provided with the retaining tooth of FIG. 1.

The device according to the invention consists of a pair of members with a substantially rectangular base, post 1 side and door 2 side, respectively, provided in the middle of the short sides with holes 3 housing tightening screws.

The member on the post 1 side is substantially a solid body of a single piece except for a cavity 1*a* on one of the side walls with greater surface, apt to house a slide 4 protruding from the member on the door 2 side. The member on the door 2 side, in turn, houses said slide 4 in a cavity 2*a* open on one of the longer side walls and a lock block 5 in a summit cavity 2*b*, said lock block 5 being arranged perpendicularly with respect to said slide 4. The head 5*a* of said lock block 5 is provided at the summit of the member. Still in the cavity 1*a* in which the slide is housed, a pair of springs 6 is provided, for which housing channels 2*c* are provided within cavity 2*b*. Slide 4 is kept in stable engagement to lock block 5 by a screw 7 associated with a washer 8.

Figure 7B:
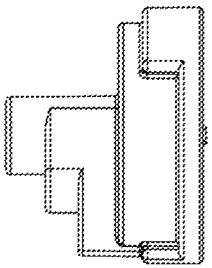
Figure 7A:
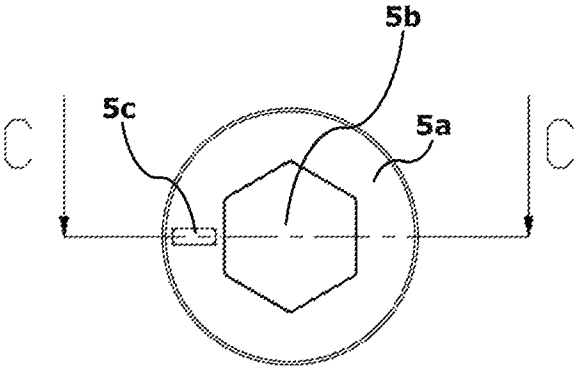
Figure 7D:
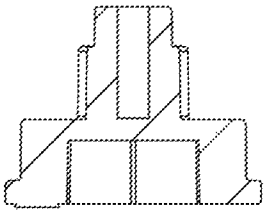

The lock block 5, illustrated in a preferred embodiment in FIGS. 7*a*-7*d* consists of a circular-base head 5*a*, from which a hexagonal-profile portion 5*b* has been removed housing a suitable tool, and which carries a transversal indicator notch 5*c*, wherefrom a cam 5*d* departs, said cam 5*d* consisting of a circular-base, cylindrical central body 5*e*, provided with a threaded central hole 5*f*, wherefrom a base 5*g* protrudes laterally, according to an ellipsoidal profile, above which base an abutment member 5*h* with a substantial trapezoidal profile with rounded corners is provided.

Figure 10A:
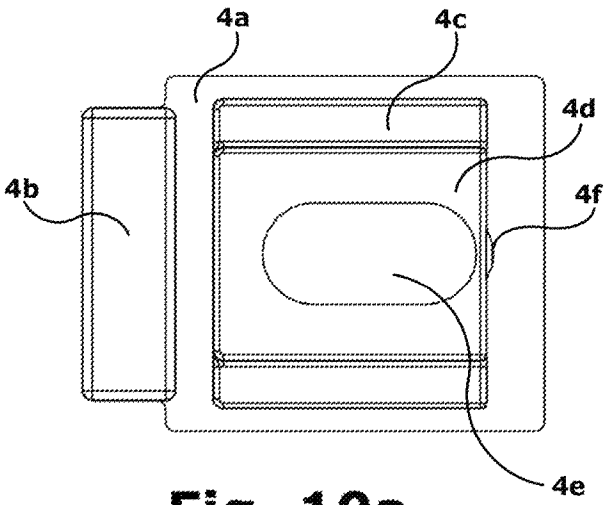
FIGS. 10*a*-10*d* are the top-plan, bottom-plan, side and rear views of the slide body of the device according to the invention.
Figure 10B:
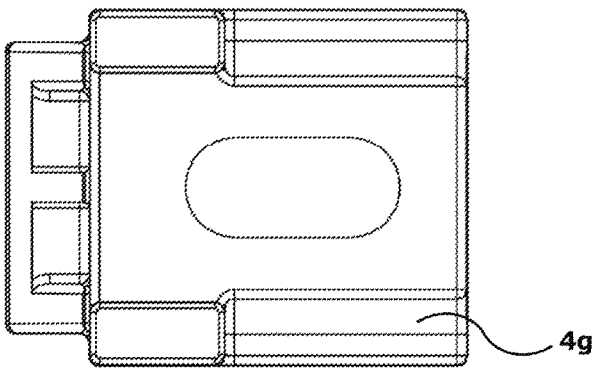
Figure 10C:
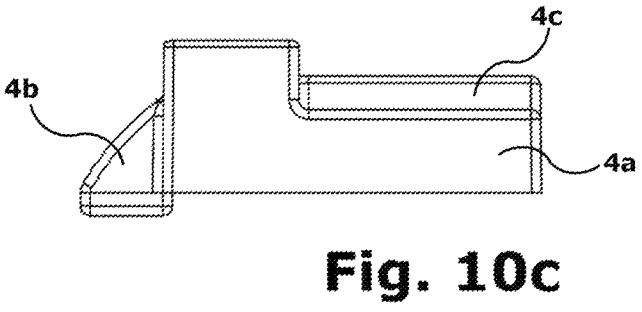
Figure 10D:
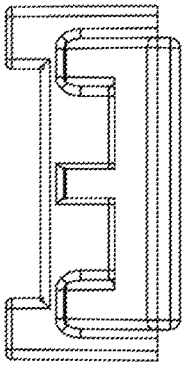

As illustrated in FIGS. 10*a*-10*d*, the slide 4 consists of a rectangular-base body 4*a*, along a short side of which a wedge 4*b* departs, provided with a perimeter rib 4*c*, which identifies a central support plane 4*d* wherein an elliptical eyelet 4*e* is obtained. In correspondence of the contact point between the contour of elliptical eyelet 4*e* and perimeter rib 4*c*, on the above-mentioned rib a thin groove 4*f* is obtained, said groove 4*f* being apt to act as retaining seat of the cam 5*d* of said lock block 5. On the bottom surface of slide 4, side cavities 4*g* housing springs 6 are obtained.

During mounting the operator must correctly arm the body provided for the housing of the lock block and of the slide with the members required for the smooth operation of the device. Therefore, the operator takes care to insert the spring bodies into special seats provided within the housing cavity of the slide, hence inserts the slide taking care that the planar portion of the wedge body is in a top position. It is subsequently provided to insert the lock block into the special housing, taking care to prepare the indicator so that it is perpendicular to the engagement surface of the slide with the opposite engagement member. Once it is mounted in the slide, the lock block is fastened thereto by means of a washer and a screw.

Therefore, the device can be mounted onto the frame, taking care that the contrast of the two members and the distance between the same are correct, and that the engagement between the slide wedge and the body which houses it is stable and sufficient.

Once the device has been mounted, the slide is prepared in an armed position, that is it is prepared to engage with the cavity provided in the opposite member, due to the thrust imparted by the spring members interspersed between the abutment surface of the housing cavity thereof and the bottom wall thereof. This arrangement implies the fact that any closing of the door automatically implies the temporary flattening of the spring means, following the thrust imparted by the surface of the opposite member on the wedge of the slide, and the subsequent fast release, with the housing of the wedge within the cavity.

Should the operator wish to open the door instead, he acts on the lock block with a suitable key, rotating the lock block by 90°. This operation implies the cam rotation, which in turn defines the translation of the slide, which goes back. The roto-translation continues until the moment when the cam finds housing within the seat 4*f* of the slide. In this position the spring is fully compressed, and the slide is locked in an open position, with the wedge fully back inside the housing chamber of its engagement member. In order to bring the slide back into a working position, it is necessary for the cam to return into its original position.

The solution just described also provides that, in the case of convenience or need, the operator can temporarily maintain free the opening of the door: the maintenance operator opens the panel, keeps the device in the open position, allowing it to operate without being forced to reopen with the key the lock to move the door, and arms again the lock at the end of the operations. It has therefore been achieved, better than what had been expected, a selective door locking/unlocking device depending on the operator's needs.

From the description just given it is also acknowledged that the device can currently operate also as monostable device, namely it is open only when the operator keeps the slide open with the key: there are no constraints which force the operator to key rotation as far as the cam engagement with the side groove, and therefore the secure door closing can nevertheless be guaranteed at each access, should it be considered suitable and desirable.

The preceding description refers to a specific embodiment. Variants can be actuated which achieve the same object, and they nevertheless fall within the scope of protection of the present invention. In particular, it can be provided that the head of the lock block is shaped in order to allow access only to different engagement systems, such as a wing spanner or other tool built especially to guarantee the necessary security against access by ill-intentioned people.

The set object has therefore been achieved, that is, of a door locking device with respect to a frame of the type which provides a correct and stable management of the opening and closing of the door.

A device has furthermore been obtained which offers improved security against acts of vandalism or of distraction, in relation to the access to the body contained within the frame.

Other changes and advantages can appear evident to a person skilled in the field without departing from the scope of protection of the present invention, as defined by the attached claims.

The invention claimed is:

1. Device for locking the opening of a door comprising two opposite elements apt to be mounted on a door and on a post, respectively, and provided with housing holes for screws of engagement with a surface, one of said opposite elements comprising a solid body, except for a cavity provided on one side wall, the other one of said opposite elements comprising an outer shell internally provided with a housing cavity of a sliding body, wherein a lock block for movement of said sliding body is furthermore provided, said lock block being housed within a cavity provided on a top surface of said outer shell as well as dampening and thrust means of said sliding body, wherein said lock block comprises a shaped head wherefrom a cam departs, rotation of said cam causing translation of the slide, said cam comprising a cylindrical central body with a circular base, with a central hole, and a base protrudes laterally from the circular base, according to an ellipsoidal profile, above which base an abutment element is provided with a substantial trapezoidal profile with rounded angles.

2. The device for locking the opening of a door as in claim 1), wherein said lock block is free to rotate between two defined settings.

3. The device for locking the opening of a door as in claim 1), wherein said sliding body comprises a rectangular-base body, along a short side of which an engagement wedge departs, provided with a perimeter rib, which identifies a central supporting plane wherein an eyelet is obtained.

4. The device for locking the opening of a door as in claim 3), wherein said sliding body has a thin groove on said perimeter rib in correspondence of a contact point between a contour of the eyelet and said perimeter rib, the thin groove configured to act as a retaining seat of the cam of said lock block.

5. The device for locking the opening of a door as in claim 3), wherein cavities are provided on a bottom surface of the one of said opposite elements bodies comprising the housing cavity of the sliding body for housing of said dampening and thrust means of said sliding body.

6. The device for locking the opening of a door as in claim 1), wherein said lock block is kept in engagement with said sliding body by means of a screw associated with a sealing washer.

* * * * *